United States Patent [19]

Webb

[11] Patent Number: 4,756,129

[45] Date of Patent: Jul. 12, 1988

[54] GROUND ANCHOR AND APPARATUS TO SET AND REMOVE SAME

[76] Inventor: Brian C. Webb, 4236 S. 76 E. Ave., Tulsa, Okla. 74145

[21] Appl. No.: 451,878

[22] Filed: Dec. 21, 1982

[51] Int. Cl.[4] ..... E02D 5/74

[52] U.S. Cl. ..... 52/157; 405/244

[58] Field of Search ..... 52/155, 157, 162–164; 73/84; 175/394, 395; 405/232, 234, 244

[56] References Cited

U.S. PATENT DOCUMENTS

| | | | |
|---|---|---|---|
| 936,350 | 10/1909 | Palmer | 175/394 |
| 1,283,246 | 10/1918 | Maloney | 52/157 |
| 1,658,155 | 2/1928 | Blackburn | 52/162 |
| 2,591,233 | 4/1952 | Browne | 175/394 |
| 4,334,392 | 6/1982 | Dziedzic | 52/157 |

FOREIGN PATENT DOCUMENTS

| | | | |
|---|---|---|---|
| 37041 | 12/1886 | Fed. Rep. of Germany | 52/157 |
| 3666 | of 1898 | United Kingdom | 405/244 |

*Primary Examiner*—David A. Scherbel
*Assistant Examiner*—Andrew J. Rudy
*Attorney, Agent, or Firm*—Head & Johnson

[57] ABSTRACT

A ground anchor has an auger fluke defined by a lower leading and upper trailing beveled cutting edges, the shape of the edges being at a non-radial or oblique angle, the disc being vertically separated in the shape of a helix and attached to an axial anchor rod. The rod is set in the ground with a socket tool that is coaxially positioned over the rod. The tool includes a helical slot engagable with the helix of the anchor fluke to rotate the anchor into the ground, to pull test the anchor, and in one embodiment capable to reverse rotate the socket tool for its removal.

1 Claim, 2 Drawing Sheets

GROUND ANCHOR AND APPARATUS TO SET AND REMOVE SAME

SUMMARY OF THE INVENTION

The invention is directed to the broad field of ground anchors, and specifically to anchors used to restrain and hold pipelines.

It is a further object of the invention to provide a pipeline anchor which incorporates a single anchor rod or post with at least one type of outwardly extending helical fluke, which anchor is rotatably driven into the earth or ground by a socket which is removably attached to the rod and fluke for rotating into the ground, testing the holding power of the anchor and removing the socket therefrom.

A further object of this invention is to provide a ground anchor and socket tool for setting the anchor in all types of soil including hard and/or rocky soils.

Another object of this invention is to provide a ground anchoring system that permits use of small size anchor rod to meet necessary ground holding force requirements, yet when used with a reusable removable socket took is capable of resisting higher torque in setting the anchor especially in hard and/or rocky soils and thus preventing the need for a larger size rod that would otherwise be needed to accomodate the torque forces.

Another object of this invention is to provide a ground anchor with an improved fluke for use especially in hard and/or rock soils, the cutting or leading edge of the fluke being formed at an off-set angle to provide greater leverage when encountering hard and/or rocky soils, especially the latter.

A yet further object of the invention is to provide a ground anchor with one or more helical flukes on a vertical rod, and means for interconnection with a socket tool that will effectively transmit a substantial part of the rotary force required to 'screw' the anchor into the ground directly to the fluke and not the vertical rod.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways comensorate with the claims herein. Also it is to be understood that the phraseology or terminology employed herein is for the purpose of description and not of limitation.

Figure 1:
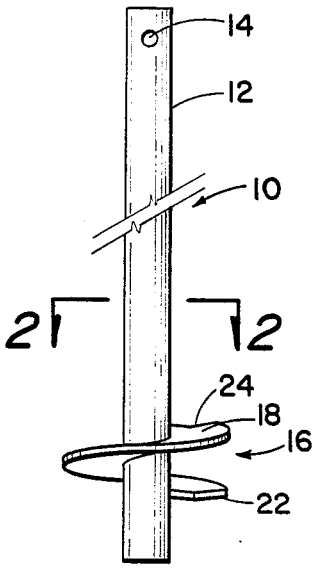
FIG. 1 is an elevational view of the anchor of this invention.
Figure 3:
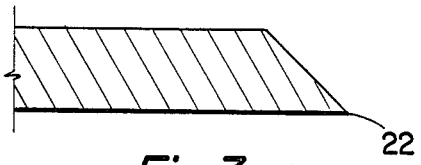
FIGS. 3 and 4 are partly sectioned views taken along the lines 3—3 and 4—4 of FIG. 2.
Figure 4:
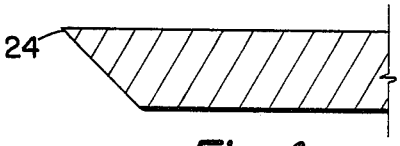
Figure 2:
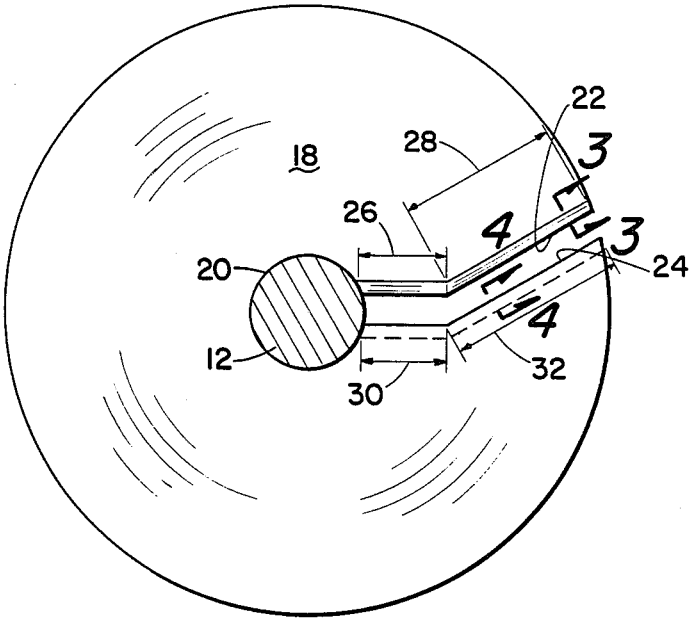
FIG. 2 is a top elevational, partly sectioned view taken along lines 2—2 of FIG. 1.

Refering now to FIG. 1, the anchor of this invention is generally designated by the numeral 10, and is of the type which includes a vertical rod 12 of desired length, which rod includes means such as a hole 14 at the top thereof for interconnection to the object which is to be anchored. Adjacent or near the bottom of the rod is one or more flukes generally designated by the numeral 16. The fluke is formed of a rod disc 18 having an opening 20 of shape compatible with the rod 12. That is, the rod could be other than round, e.g. rectangular or square. The disc is attached as by welding to the rod 12 at a desired helix or pitch creating a lower lead face 22 and a corresponding trailing face 24. Each face is beveled and of a shape that comprises, as to the leading edge, a first portion 26 extending from the opening 20 and a second portion 28. Likewise, the trailing edge includes a first portion 30 and a second portion 32. The respective second portions 28 and 32 are at an oblique angle to the first portions 26 and 30, as shown. Portions 26 and 28 are substantially transverse to an imaginary vertical plane passing through the axis of rod 12.

Figure 5:
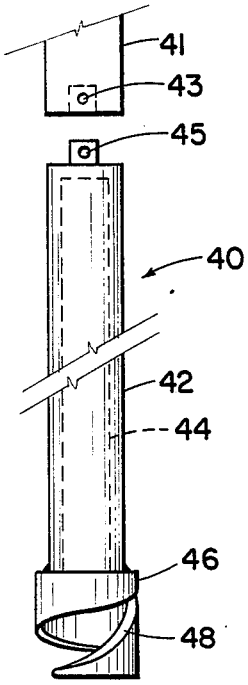
FIG. 5 is an elevational view of the anchor socket tool of this invention.
Figure 6:
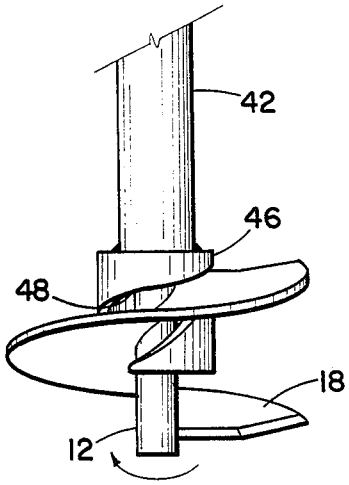
FIG. 6 is an elevational view of an assembled anchor and socket tool when used to position the anchor in the ground, and to pull test same.

Referring now to FIGS. 5 and 6, a socket tool apparatus for placing and testing the holding force of the anchor is described generally by the numeral 40. The socket tool comprises a sleeve 42, having an opening 44 therein to receive the vertical rod 12 of the anchor. At the bottom of sleeve 42 is a follower sleeve 46 which has formed therein a helical shaped follower opening 48 which is adapted to engage with the fluke 18 as shown in FIG. 6 for the purpose of rotating same in the direction of the arrow and thereby screwing the helix and the anchor rod into the ground. Once the anchor rod is set to the desired depth a rotative pressure is maintained against the fluke 18, but without rotating same, and followed by an upward pull to test the holding power of the anchor.

A means connectable to hoisting equipment (not shown) is designated as a tool 41 which includes means at 43 to accept and attach to the top of the sleeve 40 by a pin or other means interconnecting with the opening 45 at the top of the socket tool. See also co-pending application Ser. No. 408,665 filed Aug. 16, 1982 and the description therein. The tool 41 is adapted to rotate and apply pulling force to a set anchor for test purposes.

Figure 7:
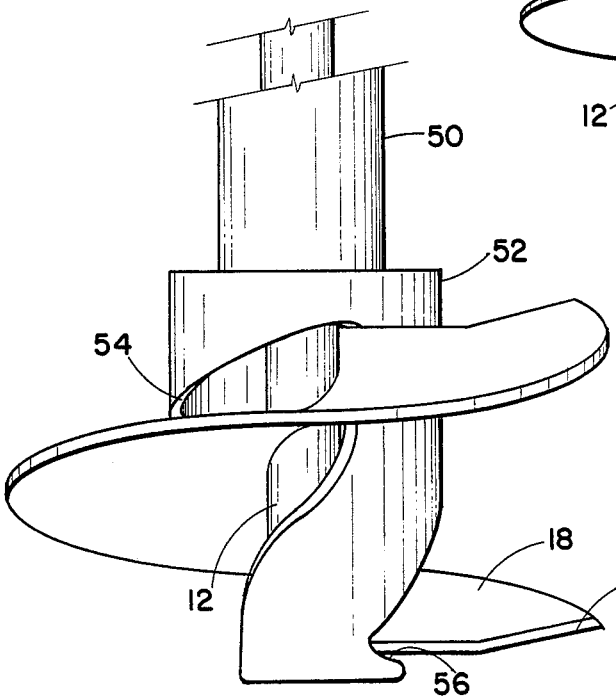
FIG. 7 is a view of an alternate embodiment socket tool for placing, testing and/or removal of ground anchors.

Referring now to FIG. 7, an alternate embodiment of the invention comprises a sleeve 50 which includes a lower sleeve 52 having a first helical opening 54 and a second helical opening 56, the latter of which is interconnectable with the lead edge 22 of the fluke 18 which permits, by reverse rotation, the removal of the anchor as the case may be.

Figure 8:
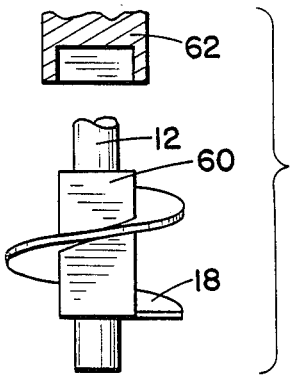
FIG. 8 is a partial view of an alternate embodiment.

Although a single disc at a substantially 180° spiral or helix is shown, it is to be understood that the disc surface can be longer or short and the number of such discs is not to be limited. In some instances the size of the vertical rod opposite the fluke or flukes may be enlarged with the upper part thereof of smaller size. For example, see the embodiment of FIG. 8 which depicts an enlarged section 60 which is square or rectangular in cross-section and which will receive a socket-tool 62 instead of applying force directly to the trailing or leading edges of the fluke.

What is claimed is:

1. A ground anchor for an object comprising a vertical rod with means at its top to connect with or hold said object to said ground, at least one round fluke attached adjacent to or near the bottom of said rod, said fluke defining a one pitch spiral and having a lower leading bevel edge and an upper trailing bevel edge, a first part of said upper and lower bevel edges adjacent said rod being substantially transverse to an imaginary vertical plane passing through the axis of said rod, and a second part longer than said first part being at an oblique angle to said first part.

* * * * *